US006422204B1

(12) United States Patent
Sinz

(10) Patent No.: US 6,422,204 B1
(45) Date of Patent: Jul. 23, 2002

(54) FEED DEVICE INTENDED FOR FEEDING FUEL OUT OF A FUEL TANK TO AN INTERNAL COMBUSTION ENGINE OF A MOTOR VEHICLE

(75) Inventor: Wolfgang Sinz, Sulzbach (DE)

(73) Assignee: Mannesmann VDO AG (DE)

( * ) Notice: Subject to any disclaimer, the term of this patent is extended or adjusted under 35 U.S.C. 154(b) by 0 days.

(21) Appl. No.: 09/643,111

(22) Filed: Aug. 21, 2000

(30) Foreign Application Priority Data

Sep. 7, 1999 (DE) ..... 199 42 548

(51) Int. Cl.[7] ..... F02M 41/00
(52) U.S. Cl. ..... 123/457; 123/461
(58) Field of Search ..... 123/514, 457, 123/510, 198 D, 459, 461, 463

(56) References Cited

U.S. PATENT DOCUMENTS

| | | | | |
|---|---|---|---|---|
| 2,653,543 A | | 9/1953 | Mott | 103/5 |
| 4,617,116 A | | 10/1986 | Seiler | 210/137 |
| 4,926,829 A | * | 5/1990 | Tuckey | 123/497 |
| 5,207,203 A | * | 5/1993 | Wagner et al. | 123/514 |
| 5,341,842 A | | 8/1994 | Chih et al. | 137/574 |
| 5,749,345 A | | 5/1998 | Treml | 123/456 |
| 6,039,030 A | * | 5/2000 | Robinson et al. | 123/457 |
| 6,065,455 A | * | 5/2000 | McLean | 123/557 |

FOREIGN PATENT DOCUMENTS

| | | |
|---|---|---|
| DE | 690 30 385 T2 | 10/1990 |
| DE | 196 34 163 A1 | 8/1996 |
| DE | 197 23 748 A1 | 6/1997 |
| DE | 196 18 707 A1 | 11/1997 |
| DE | 198 07 258 A1 | 2/1998 |
| EP | 0 777 042 A1 | 4/1997 |
| FR | 2775320 | 2/1999 |

* cited by examiner

*Primary Examiner*—Willis R. Wolfe
*Assistant Examiner*—Mahmoud Gimie
(74) *Attorney, Agent, or Firm*—Richard A. Speer; Mayer, Brown, Rowe & Maw

(57) ABSTRACT

A feed device (2) for fuel in a motor vehicle has a pressure regulating valve (7) arranged in a forward-flow line (6) leading to an internal combustion engine. The pressure regulating valve (7) is activated by a pressure within a return-flow line (10) and opens or closes a branch (8) leading to a suction jet pump (5). A pressure provided in the forward-flow line (6) can thereby be regulated with particularly high accuracy.

3 Claims, 1 Drawing Sheet

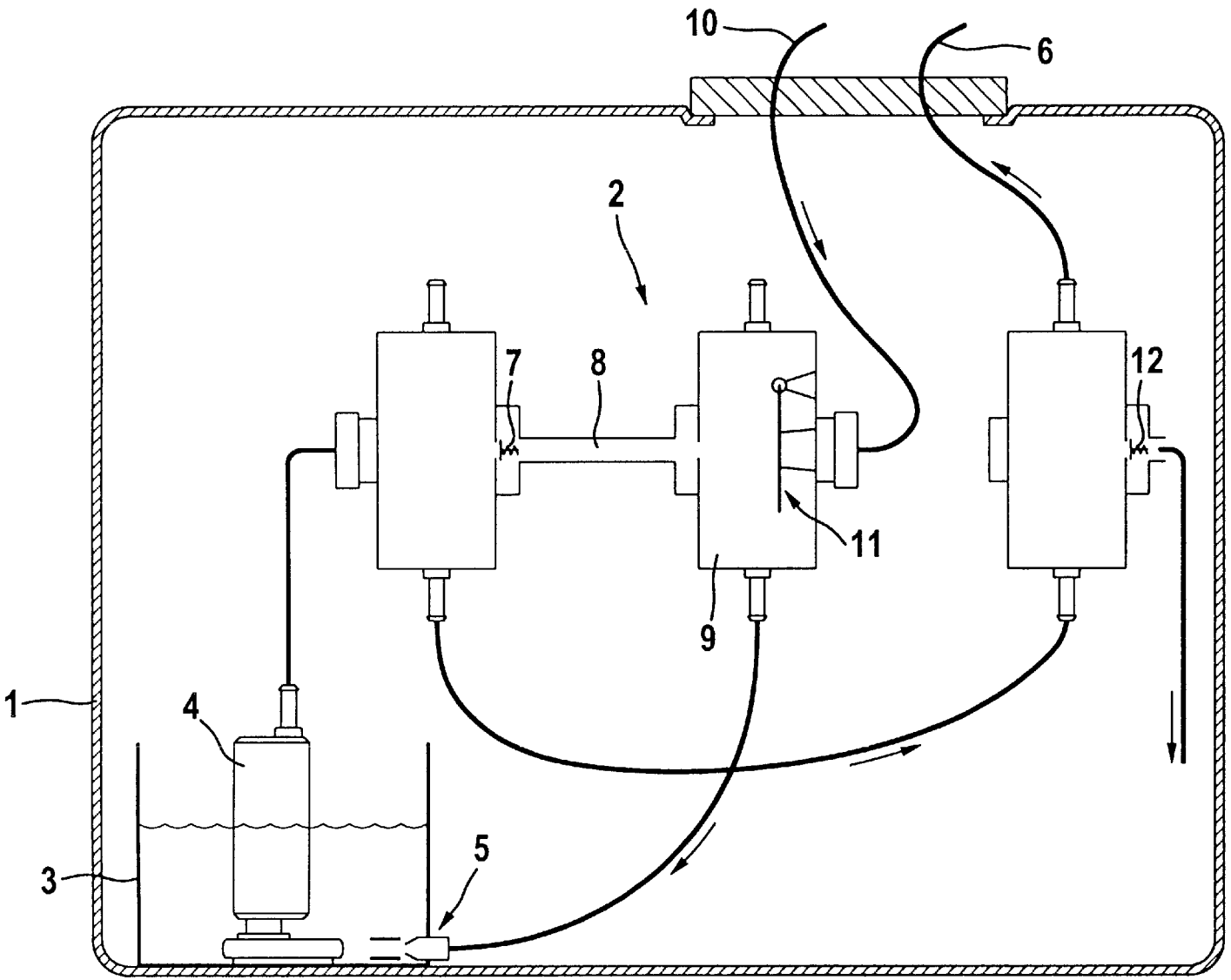
12
6
11
10
9
2
8
7
5
4
3
1

FEED DEVICE INTENDED FOR FEEDING FUEL OUT OF A FUEL TANK TO AN INTERNAL COMBUSTION ENGINE OF A MOTOR VEHICLE

BACKGROUND OF THE INVENTION

The invention relates to a feed device intended for feeding fuel out of a fuel tank to an internal combustion engine of a motor vehicle, with a feed pump and with means for controlling a pressure within a forward-flow line led from the feed pump to the internal combustion engine.

Such a feed device has as means for controlling the pressure a throttle arranged between the forward-flow line and a return-flow line led back from the internal combustion engine to the fuel tank and is known from practice. Controlling the pressure of the forward-flow line is intended to ensure that a high pressure prevails in the forward-flow line with the internal combustion engine having a high power consumption and a low pressure prevailing there during starting. Furthermore, in the case of high volume flows, pressure losses occur within the lines and are to be compensated by means of the control.

A disadvantage of the known feed device is that, particularly when the internal combustion engine is in the high-load range, the throttle often cannot reliably maintain an intended high pressure in the forward-flow line, since fuel overflows from the forward-flow line via the throttle into the return-flow line which has a low pressure.

The problem on which the invention is based is to design a feed device of the type initially mentioned, in such a way that it makes it possible to maintain the pressure within the forward-flow line with particularly high accuracy.

This problem is solved, according to the invention, in that the forward-flow line has a pressure regulating valve capable of being activated by the pressure within the return-flow line, and in that the pressure regulating valve is designed for closing or opening a branch leading from the forward-flow line into the fuel tank.

BRIEF SUMMARY OF THE INVENTION

By virtue of this design of the feed device according to the invention, the power-dependent and rotational-speed-dependent pressure in the return-flow line is utilized in order to set the operating point of the pressure regulating valve. Since the pressure in it the return-flow line is dependent on the load state of the internal combustion engine, the pressure in the forward-flow line can thereby be regulated with very high accuracy. In the case of a particularly high fuel requirement, the pressure regulating valve can close the connection to the branch completely, so that the entire fuel fed by the feed pump arrives at the internal combustion engine.

A suction jet pump connected via a branch to the forward-flow line and provided for feeding fuel out of one chamber into another chamber is usually arranged in the fuel tank. In this case, a feed of the suction jet pump can be reliably ensured if a mixer for mixing the fuel flowing back via the return-flow line with fuel branched off from the forward-flow line and intended for supplying a suction jet pump is arranged within the return-flow line. Moreover, the suction jet pump generates a counterpressure in the return-flow line, so that the control of the pressure regulating valve and therefore the pressure regulated in the forward-flow line is particularly accurate. At the same time, by the pressure regulating valve being arranged according to the invention in the forward-flow line, it becomes possible, in the case of a high fuel consumption by the internal combustion engine or a low delivery of the feed pump, for a particularly small amount of fuel to flow out via the branch into the fuel tank.

When there is-a high pressure difference between the forward-flow line and return-flow line, a high pressure in the forward-flow line can be kept below an intended value if the mixer has a non-return valve which closes the return-flow line above an intended pressure difference between the fuel branched off from the forward-flow line and the fuel flowing back via the return-flow line. This design prevents the pressure regulating valve from being activated in the case of the high pressure difference, so that the pressure regulating valve is open and allows the fuel to flow out of the forward-flow line through the branch.

According to another advantageous development of the invention, an intended maximum pressure of the forward-flow line can be maintained particularly reliably if the forward-flow line is connected to a pressure limiting valve which opens above an intended pressure and which has a connection to the fuel tank.

According to another advantageous development of the invention, emissions of fuel into the environment can be kept particularly low if the pressure limiting valve, the pressure regulating valve and the nonreturn valve are intended to be arranged within the fuel tank. As a result, all the connections of the feed device according to the invention are arranged within the fuel tank, so that leaks do not lead to an escape of fuel.

The invention permits numerous embodiments. In order to make its basic principle even clearer, one of these is illustrated in the drawing and described below.

DESCRIPTION OF THE DRAWING

The FIG. is a schematic of automotive fuel supply system showing the positioning of the pressure regulating system in accordance with the invention.

DETAILED DESCRIPTION OF THE INVENTION

The single FIGURE of the drawing shows diagrammatically a feed device 2 according to the invention, arranged in a fuel tank 1, for diesel fuel. The feed device 2 has a feed pump 4 arranged in a baffle 3 of the fuel tank 1. The baffle 3 is filled with fuel via a suction jet pump 5 arranged in the bottom region. The feed pump 4 feeds fuel via a forward-flow line 6 to an internal combustion engine which is not illustrated. A branch 8 capable of being closed by means of a pressure regulating valve 7 and leading to the suction jet pump 5 is arranged in the forward-flow line 6. Fuel discharged from the forward-flow line 6 is mixed in a mixer 9, via the branch 8, with fuel from a return-flow line 10 led back from the internal combustion engine into the fuel tank 1. The connection of the return-flow line 10 to the mixer 9 has a nonreturn valve 11 which closes when there is an intended pressure difference between the mixer 9 and return-flow line 10. Furthermore, a pressure limiting valve 12 is arranged in the forward-flow line 6. The pressure limiting valve 12 opens above an intended pressure in the forward-flow line 6 and allows the fuel to be bled into the fuel tank 1.

What is claimed is:

1. A fuel system for controlling the quantity of fuel supplied to an internal combustion engine comprising:

(a) a fuel tank containing a baffle within which is positioned a fuel pump for supplying fuel to the internal combustion engine;

(b) a forward-flow fuel line for conducting fuel from the fuel pump to the engine and a return-flow line for conducting return fuel from the engine to the fuel tank;

(c) a mixer connected to receive fuel both from the forward-flow line and from the return-flow line;

(d) a pressure regulating valve operatively connected between the forward-flow line and the mixer, whereby excess fuel from the fuel pump and not needed by the engine is fed into the mixer; and (e) a non-return valve connected between the mixer and the return-flow line; whereby (f) pressure variations within the mixer resulting from variations in the pressure in the return-flow line are used to activate the pressure regulating valve.

2. The feed device defined in claim 1 wherein the forward-flow line (6) is connected to a pressure limiting valve (12) opening above an intended pressure and having a connection to the fuel tank (1).

3. The feed device as claimed in claim 2, wherein the pressure limiting valve (12), the pressure regulating valve (7) and the nonreturn valve (11) are intended to be arranged within the fuel tank (1).

* * * * *